US005782650A

United States Patent [19]

Okabe

[11] Patent Number: 5,782,650

[45] Date of Patent: Jul. 21, 1998

[54] TERMINAL WITH PROJECTING PORTIONS PROJECTING FROM BENT PLATE PORTION AND ENGAGED IN RECESS PORTION OF HOUSING

[75] Inventor: Toshiaki Okabe, Shizuoka, Japan

[73] Assignee: Yazaki Corporation, Tokyo, Japan

[21] Appl. No.: 755,343

[22] Filed: Nov. 22, 1996

[30] Foreign Application Priority Data

Nov. 27, 1995 [JP] Japan ..... 7-307530

[51] Int. Cl.[6] ..... H01R 4/24; H01R 4/26; H01R 11/20

[52] U.S. Cl. ..... 439/399; 439/733.1

[58] Field of Search ..... 439/660, 636, 439/637, 733.1, 595, 744, 397, 399

[56] References Cited

U.S. PATENT DOCUMENTS

| | | | |
|---|---|---|---|
| 3,530,422 | 9/1970 | Goodman | 439/59 |
| 4,042,289 | 8/1977 | Heinonen et al. | 439/629 |
| 4,296,988 | 10/1981 | Warner | 339/97 R |
| 5,338,231 | 8/1994 | Wilhite | 439/660 |
| 5,380,220 | 1/1995 | Okabe | 439/595 |

*Primary Examiner*—Neil Abrams
*Assistant Examiner*—Katrina Davis
*Attorney, Agent, or Firm*—Sughrue, Mion, Zinn, MacPeak & Seas, PLLC

[57] ABSTRACT

A terminal rising-up preventing structure includes: a housing; terminal receiving chambers formed in the housing and separated by partitions so as to be disposed side by side; sloping rear plate portions formed in bottom plate portions of the terminal receiving chambers so as to extend from rear ends of the bottom plate portions in a direction of insertion of terminals, respectively; recess portions formed in rear end surfaces of the bottom plate portions, each of the recess portions having a width smaller than a width of one of the terminal receiving chambers but larger than a width of one of the sloping rear plate portions, the recess portions adjoining surfaces of the bottom plate portions via the sloping rear plate portions respectively; terminals installed into the terminal receiving chambers respectively; bent plate portions formed by partially bending the terminals toward the bottom plate portions and inserted into the sloping rear plate portions respectively; and a pair of projecting portions formed on both sides of each of the bent plate portions and inserted into the recess portion.

2 Claims, 2 Drawing Sheets

TERMINAL WITH PROJECTING PORTIONS PROJECTING FROM BENT PLATE PORTION AND ENGAGED IN RECESS PORTION OF HOUSING

BACKGROUND OF THE INVENTION

The present invention relates to a configuration of a connector for preventing pressure-contact terminals housed in a housing from rising up.

In some connectors, a terminal is partially locked to a housing to prevent the terminal from rising-up from the housing. As an example of the connector of this type, based on FIGS. 3 and 4, a connector disclosed in U.S. Pat. No. 4,296,988 will be described, which comprises projecting portions formed on a terminal and grooves formed on partitions of a terminal receiving chamber so that the projecting portions are engaged with the grooves.

FIG. 3 is an exploded perspective view of a conventional terminal rising-up preventing structure, and FIG. 4 is a sectional view of the terminal rising-up preventing structure of FIG. 3 equipped with the terminal. A housing 1 is partitioned into a plurality of terminal receiving chambers 3 by means of the partitions 5 so that the terminal receiving chambers 3 are formed so as to be disposed side by side and so terminal insertion ports 7 opened in a rear end of the housing 1. Each terminal 9 of a pressure-contact type, for example, formed by blanking and bending a rectangular metal plate is inserted into the terminal receiving chamber 3 through the terminal insertion port 7. An electric connection portion 11 is formed at a front end of the terminal 9. A pressure-contact portion 13 is formed at a center portion of the terminal 9 by bending the terminal 9 in the form of an N-shape. A pressure-contact blade portion (slot) 15 is formed by notching the pressure-contact portion 13 in the form of a U-shape so that the pressure-contact blade portion 15 opens at a top of the pressure-contact portion 13.

A pair of projecting portions 17 are formed so as to project from both sides of a top face 13*a* of the pressure-contact portion 13 respectively. As a result, the widthwise dimension w of the terminal 9 at this portion becomes larger than that of an ordinary terminal by the value corresponding to the projection of the projecting portions 17. Grooves 19 are formed in the partitions 5 of the terminal receiving chamber 3 at positions corresponding to the projecting portions 17 so as to extend in the direction of insertion of the terminal 9. The terminal 9 is inserted into the terminal receiving chamber 3 with its projecting portions 17 engaged in the grooves 19 respectively.

Therefore, the terminal 9 mounted in the terminal receiving chamber 3 is held by the partitions 5 through the engagement between the projecting portions 17 and the grooves 19 respectively. In this way, the terminal 9 is prevented from rising-up from a bottom 3*a* of the terminal receiving chamber 3.

However, since the projecting portions 17 are formed so as to project sideways from the terminal 9 and the grooves 19 for engaging with the projecting portions 17 are cut in the sides of the partitions 5, the thickness D of each partition 5 must be larger by a value corresponding to the engagement of the projecting portions 17, that is, corresponding to the depths of the grooves 19 in which the projecting portions 17 are engaged. As a result, the thickness of the partitions 5 becomes thicker so that the dimension of the housing 1 in the direction of arranging the terminal receiving chambers 3 increases, resulting in an obstacle in miniaturization of the connector.

SUMMARY OF THE INVENTION

The present invention has been attained taking the above circumstances into consideration, and it is an object thereof to provide a terminal rising-up preventing structure in which terminals are prevented from rising up without increasing the thickness of the partitions, thereby reducing the dimension of the structure in the direction along which the terminal receiving chambers are disposed side by side so that the obstacle in miniaturization of a multipolar connector can be elminated.

In order to attain the above object, the configuration of the terminal rising-up preventing structure according to the present invention comprises: a housing; terminal receiving chambers formed in the housing and separated by partitions from each other so as to be disposed side by side; grooves formed in bottom plate portions of the terminal receiving chambers so as to extend from rear ends of the bottom plate portions in a direction of insertion of the terminals, respectively; recess portions formed in rear end surfaces of the bottom plate portions, each of the recess portions having a widthwise dimension smaller than a width of one of the terminal receiving chambers but larger than a width of one of the grooves, the recess portions adjoining surfaces of the bottom plate portions via the ditch portions respectively; terminals inserted into the terminal receiving chambers respectively; bent plate portions formed by partially bending the terminals toward the bottom plate portions and inserted into the grooves respectively; and a pair of projecting portions formed on both sides of each of the bent plate portions and inserted into the recess portion.

In the thus configured terminal rising-up preventing structure, when a terminal is inserted into the terminal receiving chamber, the bent plate portion which is bent down is inserted into the grooves and, at the same time, the projecting portions are inserted into the recess portion. In this way, the mounting of the terminal into the terminal receiving chamber is completed. The projecting portions provided at the rear end engage with the recess portion to limit the moving-up of the terminal to separate from the bottom plate portion to thereby prevent the terminal from rising-up.

DETAILED DESCRIPTION OF THE INVENTION

Preferred embodiments of the terminal rising-up preventing structure of the present invention will be described below in detail with reference to the accompanying drawings.

Figure 1:
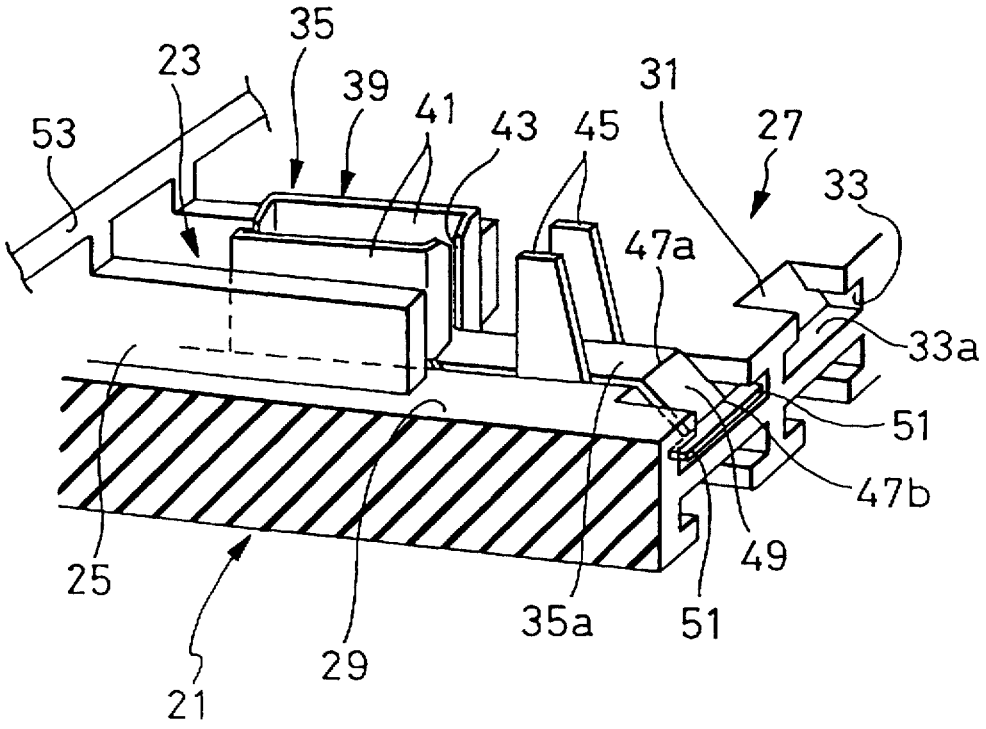
FIG. 1 is a perspective view showing a terminal rising-up preventing structure according to the present invention.
Figure 2:
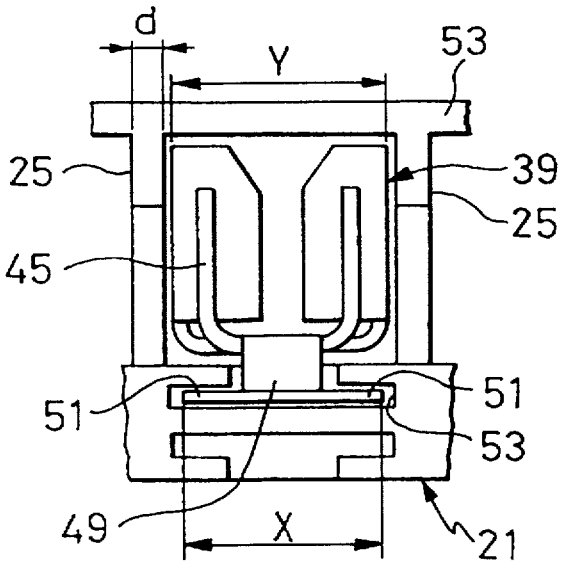
FIG. 2 is a sectional view of the terminal rising-up preventing structure of FIG. 1.
Figure 3:
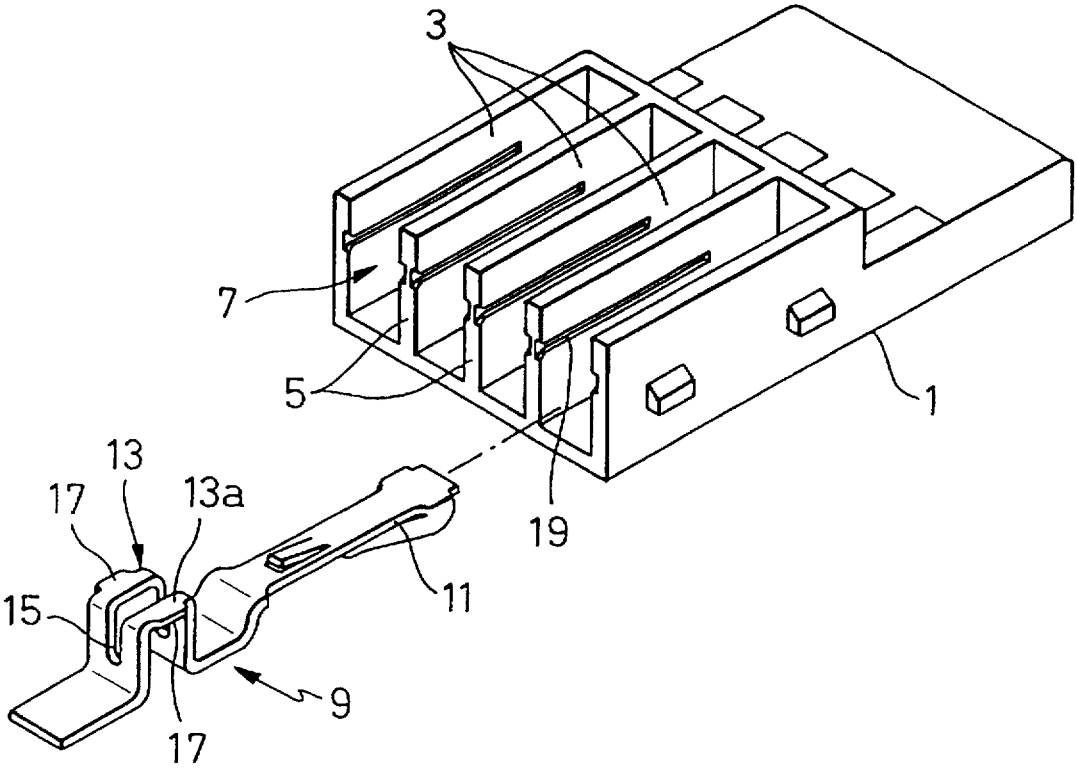
FIG. 3 PRIOR ART
FIG. 3 is an exploded perspective view of a conventional terminal rising-up preventing structure.

FIG. 1 is a perspective view of a terminal rising-up preventing structure of an embodiment of the present invention, and FIG. 2 is a sectional view of the terminal rising-up preventing structure of FIG. 1.

A housing 21 is partitioned into a plurality of terminal receiving chambers 23 by partitions 25 so that the terminal receiving chambers 23 are arranged side by side and opened at a rear end of the housing 21 so as to form terminal insertion port 27. The partitions 25 for partitioning the housing 21 into the terminal receiving chambers 23 have a minimum thickness d required to keep proper strength.

A sloping rear plate portion 31 is formed in a rear end of a bottom plate portion 29 of the terminal receiving chamber 23 by cutting a surface of the bottom plate portion 29 in a direction toward the rear end. The sloping rear plate portion 31 slopes toward the rear end. Incidentally, the rear plate portion is not limited to such a sloping rear plate portion but it may be an ordinary rear plate portion having a bottom parallel to the bottom plate portion 29. A recess portion 33 is formed in the rear end of the bottom plate portion 29 so as to be in parallel with the surface of the bottom plate portion 29. The recess portion 33 opens not only in the rear end of the bottom plate portion 29 but in the surface side via the sloping rear plate portion 31 which is cut in the surface of the bottom plate portion 29. Thus, a bottom wall 33*a* of the recess portion 33 adjoins the bottom plate portion 29 via the sloping rear plate portion 31. A width of the recess portion 33 is larger than that of the sloping ditch portion 31 and smaller than that of the terminal receiving chamber 23.

A terminal 35 of a pressure-contact type formed by blanking and bending a rectangular metal plate, for example, is inserted through the terminal insertion port 27 of the terminal receiving chamber 23. An electric connection portion (not illustrated) is formed at a front end of the terminal 35 in the direction of insertion, and a pressure-contact portion 39 is formed behind the electric connection portion. The pressure-contact portion 39 has standing walls 41 standing at both sides of the terminal. The standing walls 41 are bent to the inside of the terminal 35 at their front and rear end portions to form slit-like pressure-contact blade portions (slots) 43 into which a conductor of an electric wire (not illustrated) is forced. A pair of standing solderless contact portions 45 to be wound on the electric wire are formed behind the pressure-contact portion 39.

A rear portion of a base 35*a* of the terminal 35 is bent at a first bent portion 47*a* to form a face which is parallel to the above mentioned sloping rear plate portion 31. The rear end of the base 35*a* is bent at a second bent portion 47*b* to form a face which is parallel to the surface of the bottom plate portion 29. A part of the base 35*a* between the first bent portion 47*a* and the second bent portion 47*b* is referred to as a bent plate portion 49. At the tip end of the base 35*a* which is bent to form the end face which is parallel to the surface of the bottom plate portion 29, that is, at the tip end of the bent plate portion 49, a pair of projecting portions 51 are formed to protrude in both side directions of the terminal. The widthwise dimension X of the rear end having the pair of projecting portions 51 is smaller than the widthwise dimension Y of the pressure-contact portion 39 as shown in FIG. 2.

The assembly procedure of the thus configured housing 21 and terminal 35 will be described below.

The terminal 35 is inserted into the terminal receiving chamber 23 through the terminal insertion port 27 with the electric connection portion (not illustrated) at the head.

When the terminal 35 is inserted into the terminal receiving chamber 23, the pressure-contact portion 39 is disposed between the partitions 25, the bent plate portion 49 which is bent down abuts the sloping rear plate portion 31 so as to be parallel thereto, and the projecting portions 51 are inserted into the recess portion 33, at the same time.

Thus, the mounting of the terminal 35 onto the housing 21 is completed.

With respect to the terminal 35 fitted into the terminal receiving chamber 23 in this way, the projecting portions 51 provided at the rear end of the terminal 35 are engaged with the recess portion 33 so that the terminal 35 is limited in upward movement to separate from the bottom plate portion 29 and prevent from rising-up. On the other hand, since the front part of the terminal 35 is inserted into a front part of the terminal receiving chamber 23 having a top face plate 53, the front part of the terminal 35 is prevented from rising-up from the bottom plate portion 29.

Figure 4:
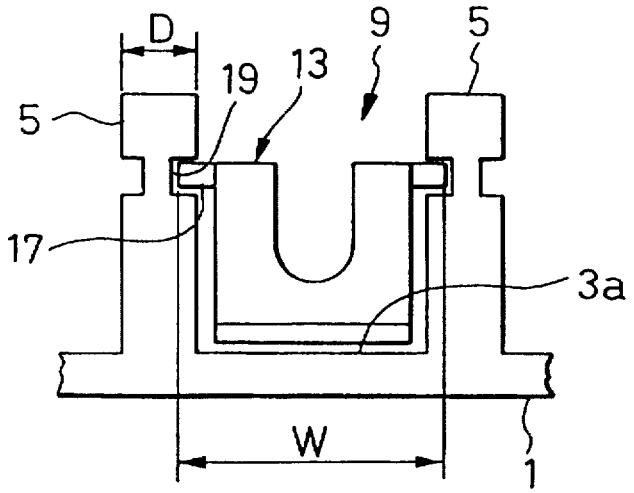
FIG. 4 PRIOR ART
FIG. 4 is a sectional view of the terminal rising-up preventing structure of FIG. 3 equipped with a terminal.

The terminal rising-up preventing structure mentioned above does not have any projecting portions projecting sideways from the pressure-contact portion 39 which is the widest part of the terminal 35 in general. Therefore, the partitions 25 can be designed to have a minimum thickness d required to separate the adjacent pressure-contact portions 39 of the respective terminals 35 from each other. Thus, it is not necessary to increase the thickness contrary to the conventional structure as shown in FIG. 4 in which the thickness D of the partitions is increased to form the grooves 19 therein with which the projecting portions 17 are engaged.

According to the terminal rising-up preventing structure mentioned above, since the sloping rear plate portion 31 is formed at the rear end of the terminal receiving chamber 23 and the recess portion 33 adjoins the surface of the bottom plate portion 29 via the sloping rear plate portion 31, the projecting portions 51 formed at the rear end of the bent plate portion 49 of the terminal 35 can be engaged with the face which is parallel to but not identical with the surface of the bottom plate portion 29. As a result, the widthwise dimension X of the portion with the pair of projections 51 formed thereon can be set smaller than the widthwise dimension of the terminal 35. Therefore, it is possible to form a terminal rising-up preventing structure without providing any projecting portions which project beyond the usual width of the terminal 35, and the thickness of the partitions 25 can be set to a minimum value, contrary to the conventional structure in which the grooves 19 are formed in the partitions 5.

In addition, if the thus configured sloping rear plate 31 and recess portions 33 are provided in each of the upper and lower surfaces of the bottom plate portion 29, it is possible to form a connector in which the upper and lower parts are symmetrical with each other and the terminals 35 can be mounted into the bottom plate portion 29 both in its upper and lower sides.

Although the projecting portions 51 are provided on the rear end of the base 35*a* of the terminal 35 in the case described above, it is also possible to provide the projecting portions 51 on a portion other than the rear end of the terminal 35. For example, such a pair of projecting portions may be provided on a lengthwise central portion in a case where the pressure-contact portion 39 is provided at the rear end of the pressure-contact terminal 35. In this case, the central portion of the terminal 35 is bent into a U-shape toward the bottom plate portion 29 to form a bent plate portion, and the projecting portions 51 are formed so as to project from both sides of the bent plate portion. Also in this case, of course, the widthwise dimension X of the bent plate portion including the projecting portions is smaller than the widthwise dimension Y of the terminal 35.

As described above in detail, according to the terminal rising-up preventing structure of the present invention, a rear plate portion is formed in a bottom plate portion of a terminal receiving chamber, a recess portion adjoining the bottom plate portion via the rear plate portion is formed in the bottom plate portion at its rear end, and a pair of projecting portions are engaged in the recess portion on a face which is parallel to but not identical with the surface of the bottom plate portion, so that the widthwise dimension of the portion including the pair of projecting portions can be smaller than the widthwise dimension of the terminal. Therefore, it is possible to provide the terminal rising-up preventing structure without providing any projecting portions projecting sideways from the terminal to increase the usual width of the terminal, and the thickness of the partitions can be set to a minimum value. As a result, it is possible to decrease the dimension of the connector in the direction along which terminal receiving chambers are provided side by side so that it is possible to eliminate the obstacle in miniaturization of a multipolar connector.

What is claimed is:

1. A terminal rising-up preventing structure comprising:

a housing;

terminal receiving chambers formed in said housing and separated by partitions from each other so as to be disposed side by side;

rear plate portions formed in bottom plate portions of said terminal receiving chambers so as to extend from rear ends of said bottom plate portions in a direction of insertion of terminals, respectively;

recess portions formed in rear end surfaces of said bottom plate portions, each of said recess portions including a pair of diametrically opposed notches formed at a tip end of each of said rear end surfaces of said bottom plate portions, each of said recess portions having a widthwise dimension smaller than a width of one of said terminal receiving chambers but larger than a width of one of said rear plate portions, said recess portions adjoining surfaces of said bottom plate portions via said rear plate portions, respectively;

terminals inserted into said terminal receiving chambers, respectively;

bent plate portions formed by partially bending said terminals toward said bottom plate portions and inserted into said rear plate portions, respectively; and a pair of projecting portions formed on both sides of each of said bent plate portions and to be inserted into said recess portion.

2. A terminal rising-up preventing structure as claimed in claim 1, wherein:

each of said rear plate portions is a sloping rear plate portion sloping toward the rear end of said bottom plate portion; and each of said bent plate portions of said terminals is formed at a rear end of said terminal so as to be in parallel to said sloping rear plate portion.

* * * * *